US006145711A

United States Patent [19]

Prosper et al.

[11] Patent Number: 6,145,711

[45] Date of Patent: Nov. 14, 2000

[54] PORTABLE SPRAYER WITH POWER PUMP

[75] Inventors: Jacob M. Prosper, Brockville; Tri Nguyen, Toronto; Colin Dyke, North Augusta; Jerry N. Moscovitch, Toronto; Rene Allen, Oakville, all of Canada; Gabriel E. Concari, Eldersburg, Md.

[73] Assignee: Black & Decker Inc., Newark, Del.

[21] Appl. No.: 09/020,187

[22] Filed: Feb. 6, 1998

Related U.S. Application Data

[60] Provisional application No. 60/044,559, Apr. 24, 1997.

[51] Int. Cl.[7] ..... B65D 83/00

[52] U.S. Cl. ..... 222/401; 222/61; 222/608

[58] Field of Search ..... 222/401, 608, 222/153.09, 61, 333; 239/346, 355, 359, 722, 302

[56] References Cited

U.S. PATENT DOCUMENTS

| | | | |
|---|---|---|---|
| 929,597 | 7/1909 | Johnson . | |
| 982,140 | 1/1911 | Keighley . | |
| 1,277,269 | 8/1918 | Sturcke . | |
| 1,714,296 | 5/1929 | Carlson . | |
| 2,086,969 | 7/1937 | Strelow . | |
| 2,227,222 | 12/1940 | Henderson | 299/40 |
| 2,385,514 | 9/1945 | Hawkins | 214/65.4 |
| 2,465,554 | 3/1949 | Roy | 230/217 |
| 2,493,599 | 1/1950 | Schroeder | 222/176 |
| 2,529,645 | 11/1950 | Winks . | |
| 2,544,651 | 3/1951 | Boardman . | |
| 2,629,539 | 2/1953 | Drewes, Jr. | 230/58 |
| 2,853,212 | 9/1958 | Anderson | 222/437 |
| 2,953,387 | 9/1960 | Portner | 280/47.13 |
| 3,050,260 | 8/1962 | McCrae | 239/150 |
| 3,173,584 | 3/1965 | Giavasis | 222/263 |
| 3,608,832 | 9/1971 | Hughes et al. | 239/419 |
| 3,797,743 | 3/1974 | Kommers et al. | 239/148 |
| 3,856,211 | 12/1974 | Williams | 239/685 |
| 3,894,816 | 7/1975 | Davis et al. | 417/413 |
| 3,901,449 | 8/1975 | Bochmann | 239/332 |
| 3,915,351 | 10/1975 | Kiralfy | 222/385 |
| 3,940,843 | 3/1976 | Yeager | 29/437 |
| 3,963,178 | 6/1976 | Collins | 239/8 |
| 3,977,602 | 8/1976 | Kirch | 239/74 |
| 4,030,665 | 6/1977 | Koyama | 239/373 |
| 4,034,916 | 7/1977 | Forsberg | 239/373 |
| 4,080,105 | 3/1978 | Connell | 417/26 |
| 4,104,744 | 8/1978 | Odencrantz | 4/159 |
| 4,135,669 | 1/1979 | Bridges et al. | 239/373 |
| 4,166,579 | 9/1979 | Beise | 239/526 |
| 4,269,356 | 5/1981 | Rose | 239/167 |
| 4,301,971 | 11/1981 | Cornelius et al. | 239/351 |
| 4,320,859 | 3/1982 | Shy | 222/401 |
| 4,618,099 | 10/1986 | Nagao et al. | 239/332 |
| 4,621,984 | 11/1986 | Fussell | 417/234 |
| 4,638,949 | 1/1987 | Mancel | 239/307 |
| 4,651,903 | 3/1987 | Pagliai | 222/175 |
| 4,702,419 | 10/1987 | Luchsinger | 239/333 |
| 4,712,983 | 12/1987 | Moynihan | 417/234 |

(List continued on next page.)

FOREIGN PATENT DOCUMENTS

| | | |
|---|---|---|
| 656686 | 1/1963 | Canada . |
| 297 938 | 1/1989 | European Pat. Off. . |
| 2055868 | 5/1972 | Germany . |
| 56-83463 | 7/1981 | Japan . |
| 63-73174 | 5/1988 | Japan . |
| 63-152675 | 10/1988 | Japan . |
| 2164533 | 5/1988 | United Kingdom . |
| 2102662 | 2/1993 | United Kingdom . |
| WO 95/01225 | 12/1995 | WIPO . |

*Primary Examiner*—Kevin Shaver
*Assistant Examiner*—Thach Bui
*Attorney, Agent, or Firm*—Foley & Lardner

[57] ABSTRACT

A frame for a portable sprayer having an interlocking joint for securing sections of a frame on opposite sides of a tank. The interlocking joint facilitates attachment and detachment of tanks with respect to the frame, as well as securing a telescopic handle relative to the frame. An extension rib prevents the tank from tipping-over.

15 Claims, 24 Drawing Sheets

U.S. PATENT DOCUMENTS

| | | | |
|---|---|---|---|
| 4,717,074 | 1/1988 | Karliner et al. | 239/288 |
| 4,723,710 | 2/1988 | Lucore, II | 239/124 |
| 4,725,004 | 2/1988 | Baran, Jr. | 239/164 |
| 4,776,766 | 10/1988 | Brent | 417/44 |
| 4,782,982 | 11/1988 | Ellison | 222/1 |
| 4,787,560 | 11/1988 | DeYoreo | 239/373 |
| 4,865,255 | 9/1989 | Luvisotto | 239/149 |
| 4,881,687 | 11/1989 | Ballu | 239/332 |
| 4,890,752 | 1/1990 | Ota et al. | 215/1 |
| 4,913,345 | 4/1990 | Setter | 239/127 |
| 4,925,105 | 5/1990 | Lin | 239/154 |
| 4,930,664 | 6/1990 | Ellison | 222/1 |
| 4,930,686 | 6/1990 | Ellison | 222/394 |
| 4,971,498 | 11/1990 | Goforthe | 411/134 |
| 4,972,975 | 11/1990 | Fuhrig | 222/182 |
| 4,984,742 | 1/1991 | Ellison | 239/373 |
| 5,014,884 | 5/1991 | Wunsch | 222/333 |
| 5,029,758 | 7/1991 | Chayer | 239/172 |
| 5,033,520 | 7/1991 | Kuehmichel | 141/231 |
| 5,064,170 | 11/1991 | Feyen | 251/344 |
| 5,072,884 | 12/1991 | Ellison et al. | 239/373 |
| 5,119,993 | 6/1992 | Gunzel | 239/654 |
| 5,127,808 | 7/1992 | Nichols et al. | 417/411 |
| 5,150,837 | 9/1992 | Ferrari | 239/153 |
| 5,154,317 | 10/1992 | Roppolo, III | 222/608 X |
| 5,248,089 | 9/1993 | Bekius | 239/154 |
| 5,301,877 | 4/1994 | Madison | 239/154 |
| 5,307,995 | 5/1994 | Jackson et al. | 239/373 |
| 5,395,216 | 3/1995 | Lin | 417/234 |
| 5,399,072 | 3/1995 | Westphal | 417/234 |
| 5,415,353 | 5/1995 | Jackson | 239/530 |
| 5,429,306 | 7/1995 | Schneider | 238/154 |
| 5,494,191 | 2/1996 | Benson | 222/608 X |
| 5,509,577 | 4/1996 | Benson | 222/61 |
| 5,553,780 | 9/1996 | Gjerde | 239/71 |
| 5,636,791 | 7/1997 | Leer . | |
| 5,639,226 | 6/1997 | Boutrup et al. | 417/411 |
| 5,695,121 | 12/1997 | Stillions, Jr. et al. | 239/126 |
| 5,931,207 | 8/1999 | Gianino | 141/382 |

PORTABLE SPRAYER WITH POWER PUMP

CROSS REFERENCE TO RELATED APPLICATION

This application is based on provisional patent application U.S. Ser. No. 60/044,559 filed on Apr. 24, 1997.

BACKGROUND OF THE INVENTION

Field of the Invention

The disclosed invention relates to portable sprayers of pressurized liquids, and in particular to a frame for a garden sprayer and combinations of a frame and sprayer.

Background of Related Art

Pressurized sprayers of various types are currently available on the market. Generally, the available sprayers suffer from many disadvantages. Most portable sprayers are either limited in capacity or are difficult to maneuver. Furthermore, many currently available sprayers require manual pumping and thus are difficult to use. Various types of sprayers, as described below, are currently known in the art.

U.S. Pat. No. 4,925,105 to Lin discloses a rechargeable battery powered garden sprayer. The user can hold the sprayer with a strap or handle.

U.S. Pat. No. 5,014,884 to Wunsch discloses a spray container having a piston or gear pump. The pump is used to pump the fluid out of the container rather than to pressurize the tank.

U.S. Pat. No. 4,618,099 to Nagao et al. discloses an electric spraying device having a pump and a motor. The tank can be carried by its handle.

U.S. Pat. No. 4,135,669 to Bridges et al. discloses a wheeled sprayer with a pressurized liquid reservoir.

U.S. Pat. No. 4,651,903 to Pagliai discloses a motorized pump pressurized liquid sprayer. A vessel pressurized by the pump is centrally disposed within a container.

U.S. Pat. No. 5,072,884 to Ellison et al. discloses a garden sprayer having an elliptically shaped wand and a manual pump.

U.S. Pat. No. 4,881,687 to Ballu discloses a portable liquid sprayer having a manually operated pump.

U.S. Pat. No. 3,901,449 to Bochmann discloses a portable sprayer having a handle and a pump powered by rechargeable batteries.

U.S. Pat. No. 5,150,837 to Ferrari discloses a backpack sprayer with a manually operated pump.

U.S. Pat. No. 4,787,560 to DeYoreo discloses a portable liquid sprayer with two handles.

SUMMARY OF THE INVENTION

An object of the invention is to provide a frame for easily and safely maneuvering a sprayer by a user.

A further object is to provide a wheeled frame for supporting and transporting a tank. The frame, and an associated handle, are readily assembled with interlocking connections.

A further object is to provide a tank that is easily detachable from the frame, such that it is not necessary to fill the same tank with substances that should not be mixed.

A further object is to provide the frame with an anti-tip over feature, such that when the tank is empty, the user does not have to hold it in place.

A further object is to provide a battery powered pump for pressurizing the tank in order to minimize user effort.

A further object is to provide a method of assembling a frame for a portable garden sprayer.

A further object is to provide a combination sprayer and frame according to the present invention.

The foregoing and further objects have been achieved according to one aspect of the present invention which provides a frame for supporting a fluid tank comprising an upper section joined to a lower section by means of an interlocking joint.

According to another aspect of the present invention, there has been provided, a wheeled portable sprayer comprising a tank, a pump unit, and a frame including a handle.

According to another aspect of the present invention, there has been provided, a frame for supporting a fluid tank on a surface. The frame includes: a lower support arm for engaging the tank; and an extension member projecting from the lower support arm for contacting the surface if the tank is tilted; wherein the extension member prevents the tank from tipping over.

According to another aspect of the present invention, there has been provided, a portable sprayer assembly which includes: a tank for containing a fluid; and a frame for mounting the tank. The frame includes: a collar for connecting with an upper portion of the tank; an interlocking joint having an adjustable connecting portion; and two recessed sections for connection with two tabs on a lower portion of the tank; wherein the tank is secured with respect to the frame when the adjustable connecting portion is in a tightened position and is released when the adjustable connecting portion is in a loosened position.

According to yet another aspect of the present invention, there has been provided, a method of assembling a frame for a tank, the method comprising the steps of loosening an interlocking joint between upper and lower frame sections, separating the frame sections so as to insert the tank therebetween, contracting the frame sections to retain the tank, and tightening the interlocking joint.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENTS

Figure 1:
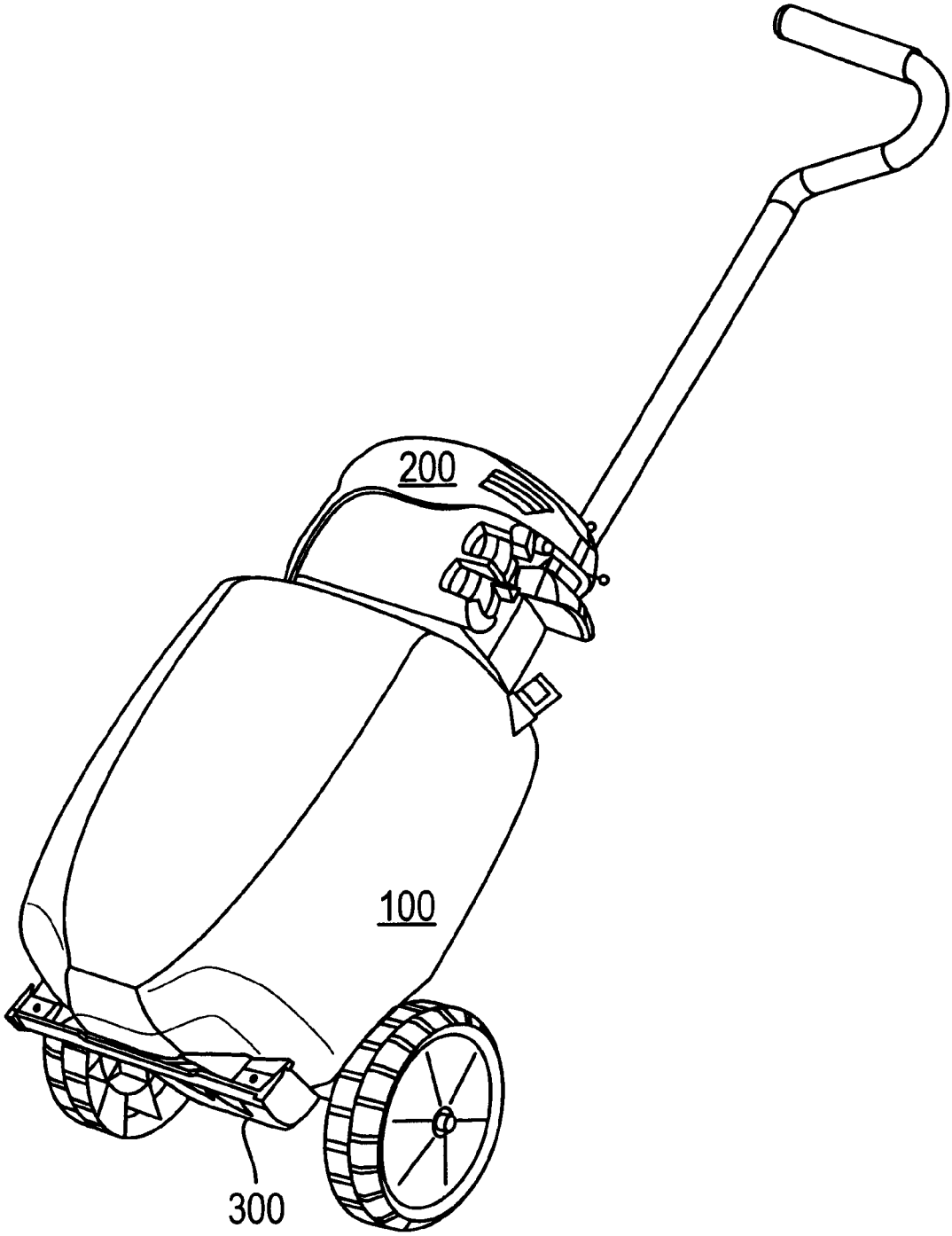
FIG. 1 is a perspective view of the sprayer assembly.

FIG. 1 is a perspective view of the sprayer assembly. Tank 100 is mounted on frame 300. Head 200 is secured to tank 100. Each of these three components is described in detail in conjunction with the drawings.

FIGS. 2–7 show additional views of the sprayer assembly.

Figure 8:
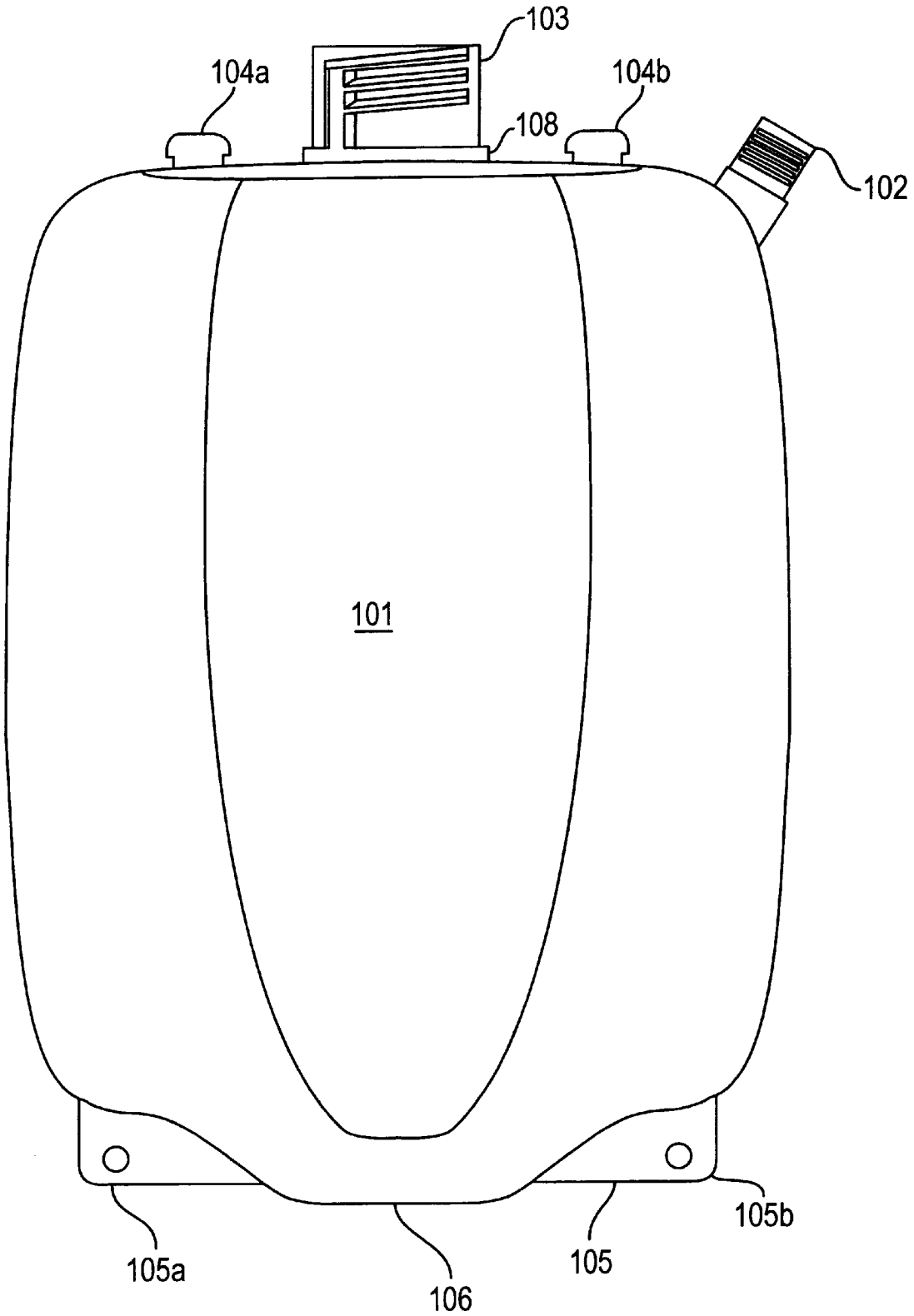
FIG. 8 is a front elevation view of the tank of the sprayer assembly.

Tank 100 as shown in FIG. 8 has a curved front wall 101. On top of front wall 101 is an externally threaded inlet 103. On the side of tank 100 is externally threaded outlet 102. Locking projections 104*a* and 104*b* are provided at the top of the tank for locking the frame to the tank. On the bottom portion of tank 100, a supporting surface 106 is shaped to be disposed adjacent the frame 300 (not shown in FIG. 8). An engaging surface 105 includes tabs 105*a* and 105*b* that are provided for engagement with the frame 300.

Figure 9:
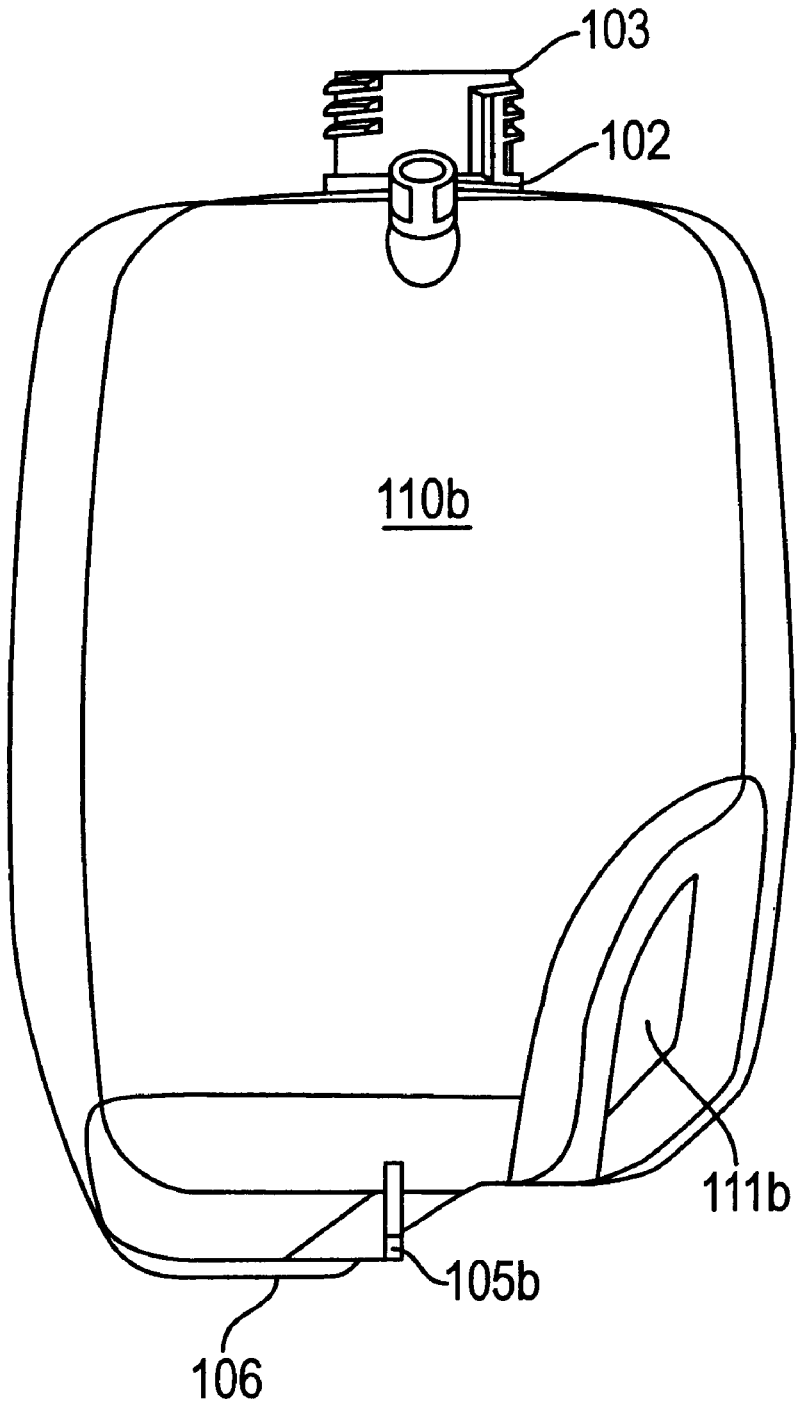
FIG. 9 is a right-side elevation view of the tank of the sprayer assembly.
Figure 10:
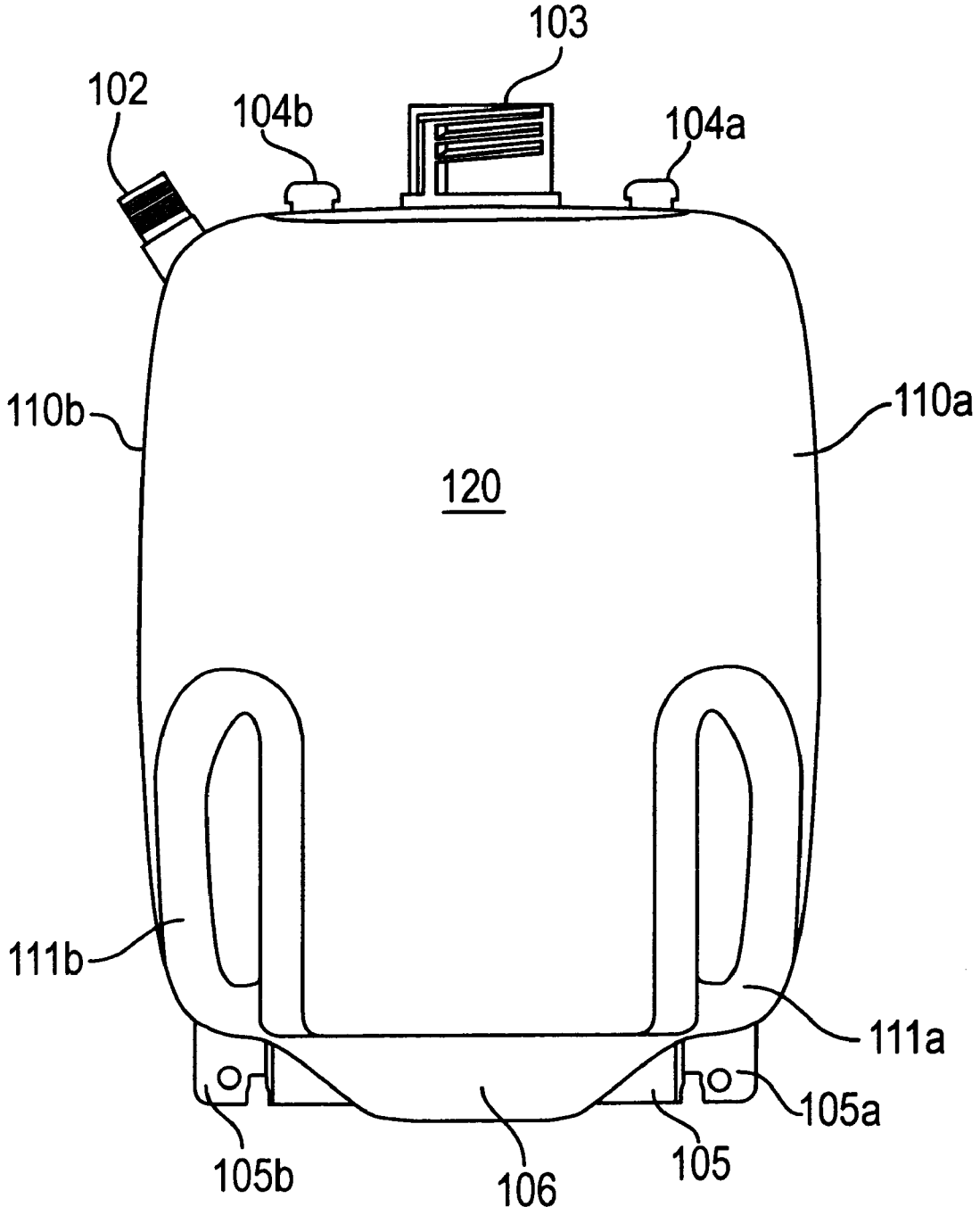
FIG. 10 is a rear elevation view of the tank of the sprayer assembly.

FIG. 9 is a side elevation of tank 100, which additionally shows wheel well 111*b* within sidewall 110*b*. FIG. 10 is a rear elevation of the tank that shows both wheel wells 111*a* and 111*b*. The wheel wells extend forward from rear wall 120.

Figure 11:
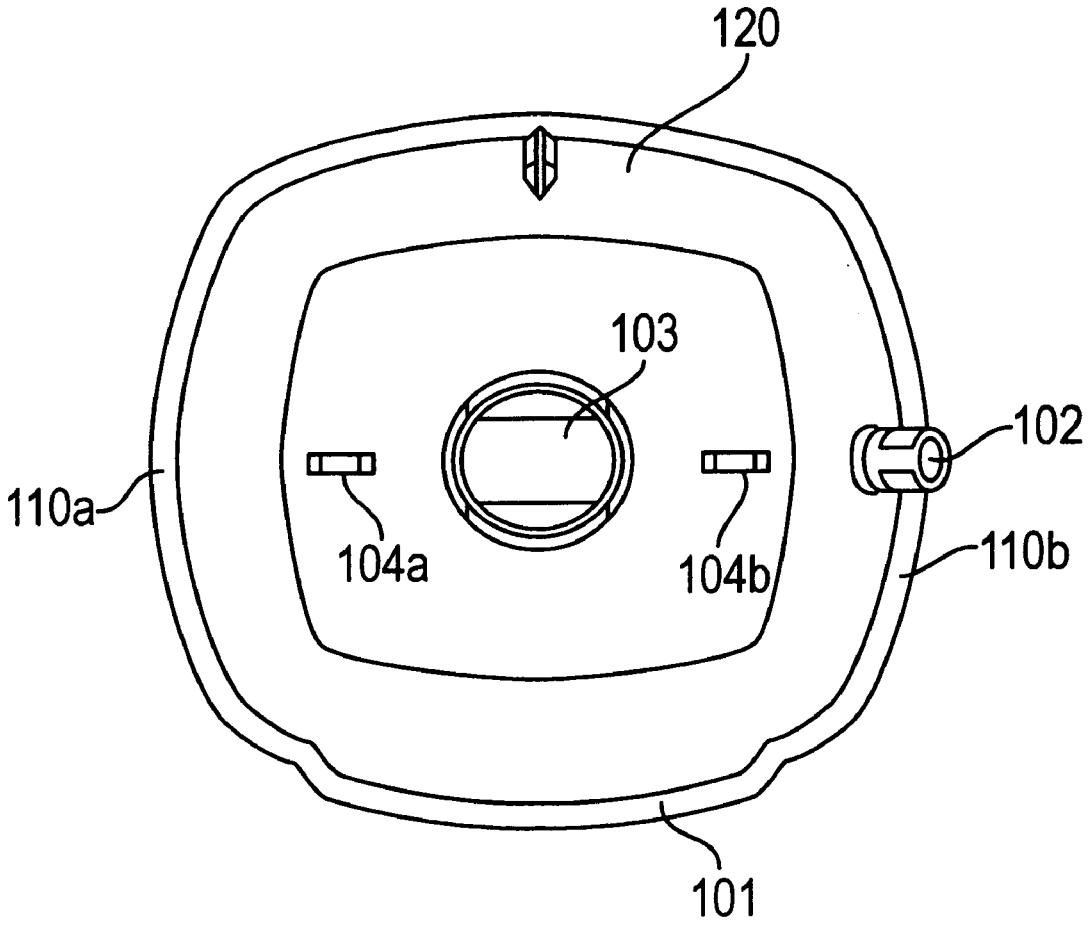
FIG. 11 is a top plan view of the tank of the sprayer assembly.

FIG. 11 is a top plan view of the tank that shows the outline of tank 100. The tank has four sidewalls 101, 110*a*, 110*b*, and 120 and each wall is of a curved configuration.

The walls of tank 100 are formed such that a safe failure mode is provided for the tank. The thickness of the walls is varied such that the walls are thinnest at the top of the tank. Preferably, the thinner wall portions are formed at the top of the tank, under a connecting portion of the frame shown in FIG. 14. Accordingly, if failure occurs, no leakage will occur from the bottom of the tank. Further, the provision of a safe failure mode allows most portions of the tank to be thinner than would otherwise be required.

Figure 12:
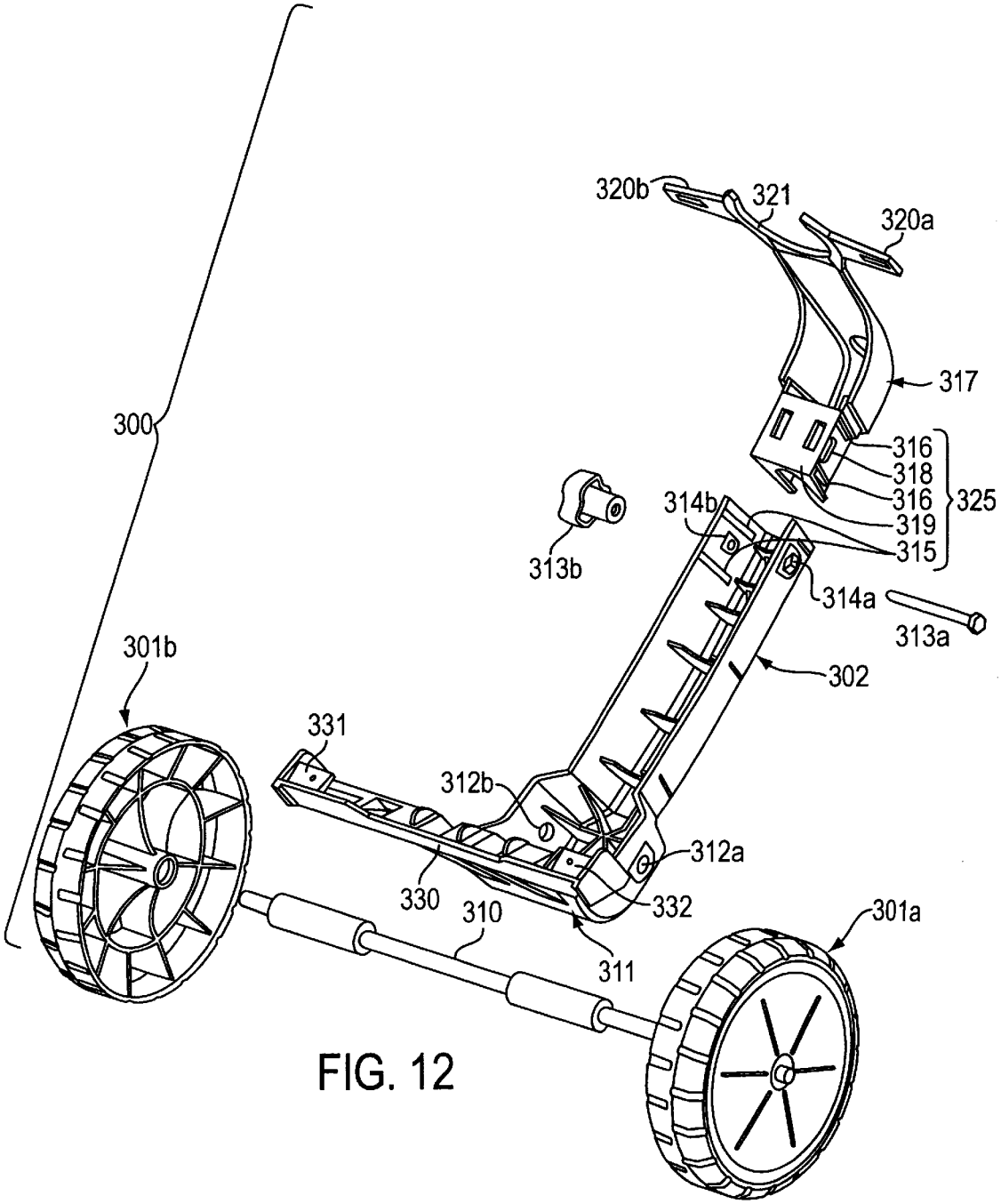
FIG. 12 is an exploded perspective view of the frame of the sprayer assembly.

FIG. 12 is an exploded perspective view of frame 300. Wheels 301*a* and 301*b* are connected by axle 310. Apertures 312*a* and 312*b* receive axle 310, as is more clearly shown in FIG. 13. Supporting portion 311 extends below axle 310 (in the position shown in FIG. 12), and shaft portion 302 extends upward from supporting portion 311 and connects with upper arm 317. An interlocking connection between shaft 302 and upper arm 317 is accomplished by inserting connecting portion 319 of upper arm 317 into shaft 302 such that ribs 316 of the upper arm engage ribs 315 on shaft 302. Ribs 315 are located on both sides of shaft 302 and ribs 316 are located on both sides of upper arm 317. The connection forms interlocking joint 325 which is then secured by inserting connectors 313*a* and 313*b* (e.g. a bolt and nut) through apertures 314*a* and 314*b* in the shaft and apertures 318 in the upper arm.

Loosening connectors 313*a* and 313*b* allows the assembly a limited degree of relative displacement between shaft 302 and upper arm 317 such that frame 300 can be manipulated for easy replacement of the tank 100. Tightening the connectors 313*a* and 313*b* interlocks ribs 315 and 316 to secure frame sections 302 and 317 together, thereby securely retaining the tank 100 with respect to the frame 300.

Additionally, support portion 311 comprises an extension rib 330 that acts as an outrigger and provides an anti-tip feature. When the sprayer assembly is tilted forward, rib extension 330 of support arm 311 will touch the ground widening the sprayer's footprint, and ensuring that the sprayer's center of gravity is contained within the boundaries of the footprint.

Figure 13:
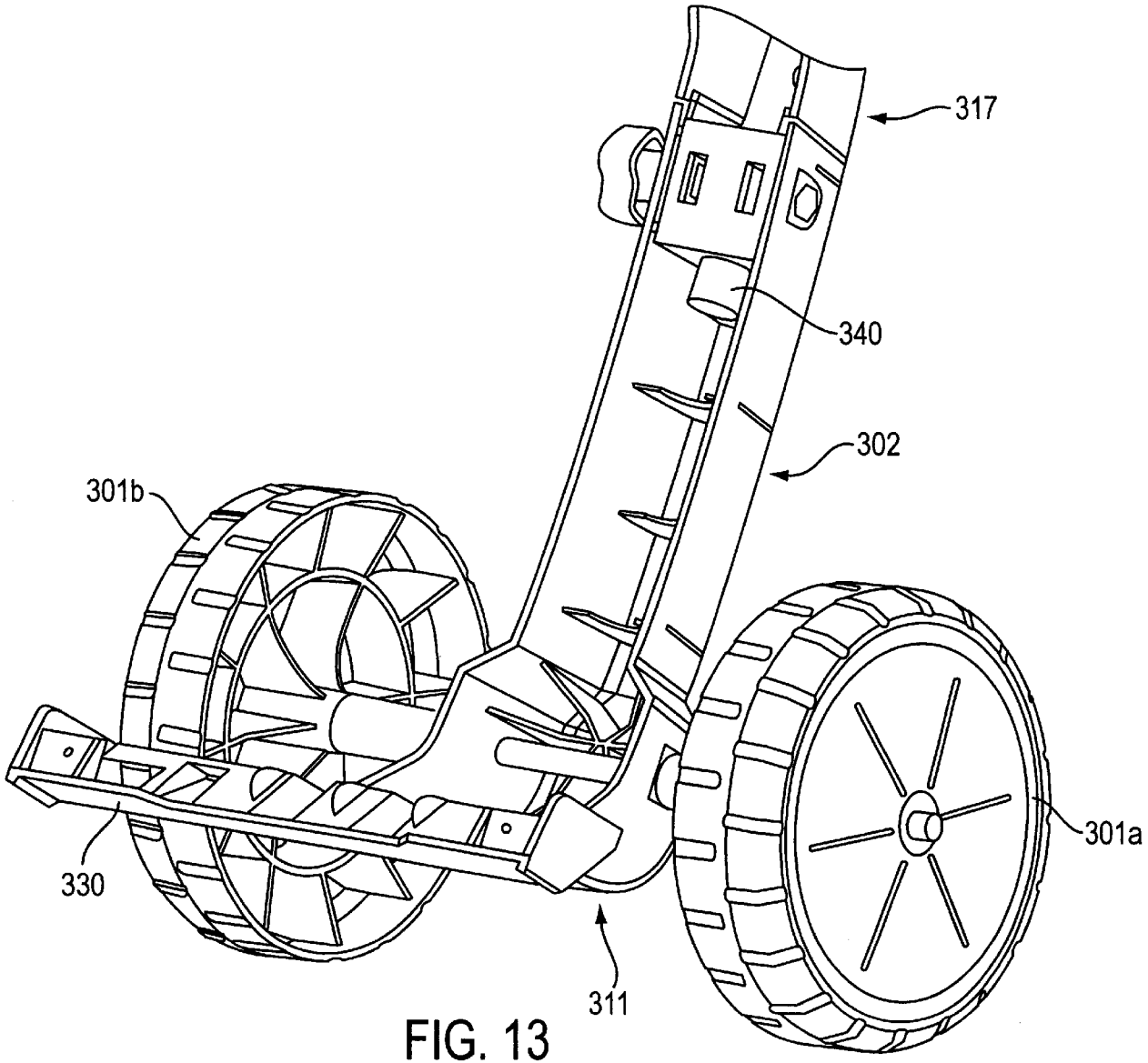
FIG. 13 is a perspective view of a lower portion of the frame of the sprayer assembly.

FIG. 13 further shows the lower portion of an elongated tube 340 integrated into joint 325 and functioning as a handle. The entire configuration of the handle is shown in FIG. 1. With connectors 313*a* and 313*b* removed, tube 340 can be moved up and down to adjust the height of the handle.

Figure 2:
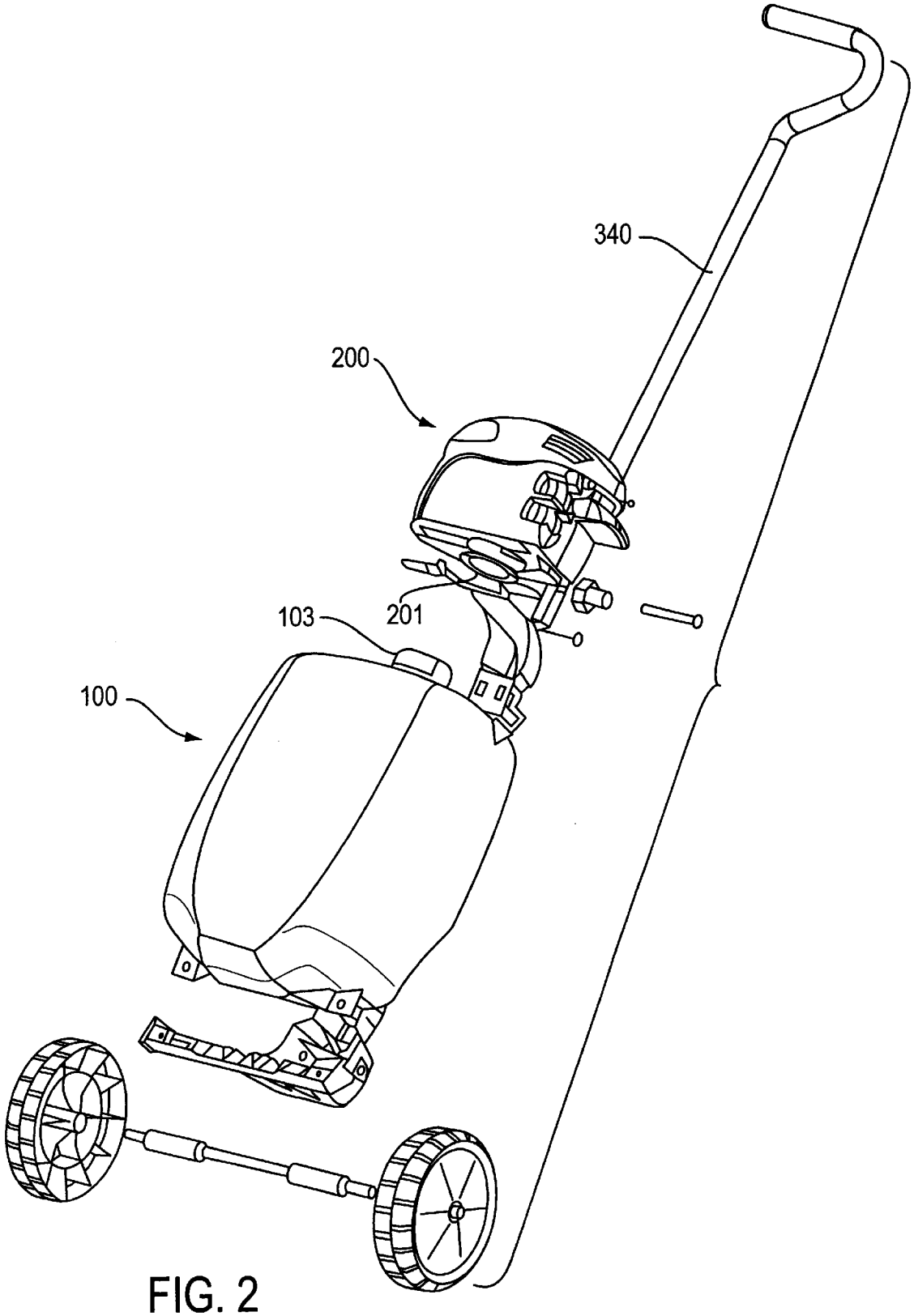
FIG. 2 is an exploded perspective view of the sprayer assembly.
Figure 3:
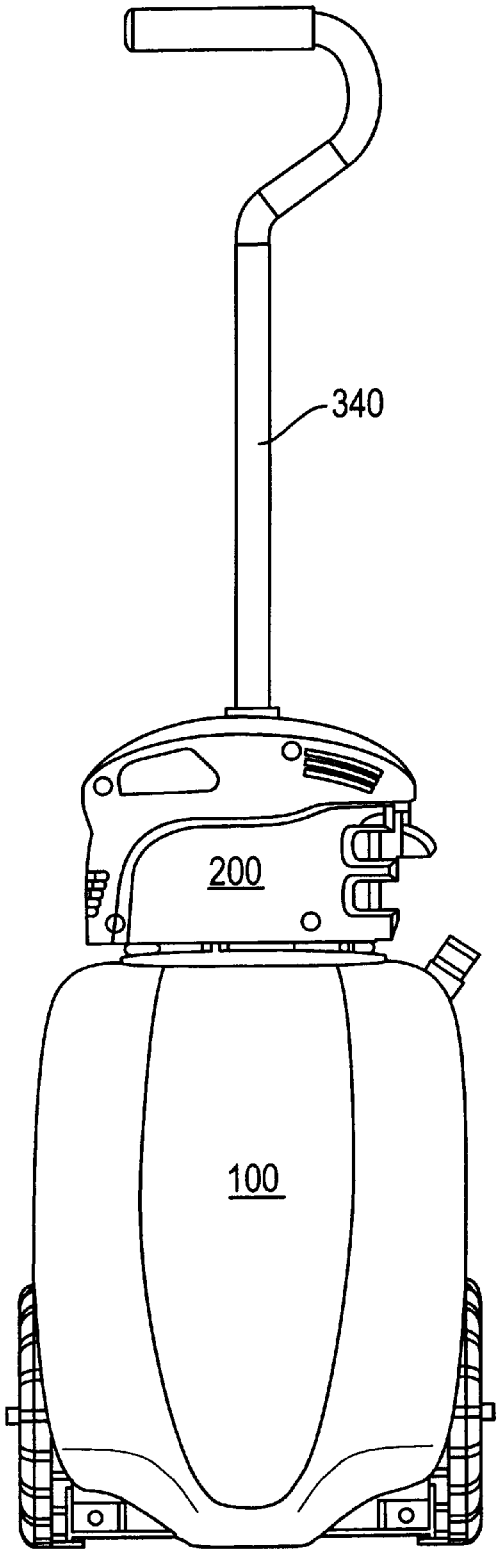
FIG. 3 is a front elevation view of the sprayer assembly.
Figure 4:
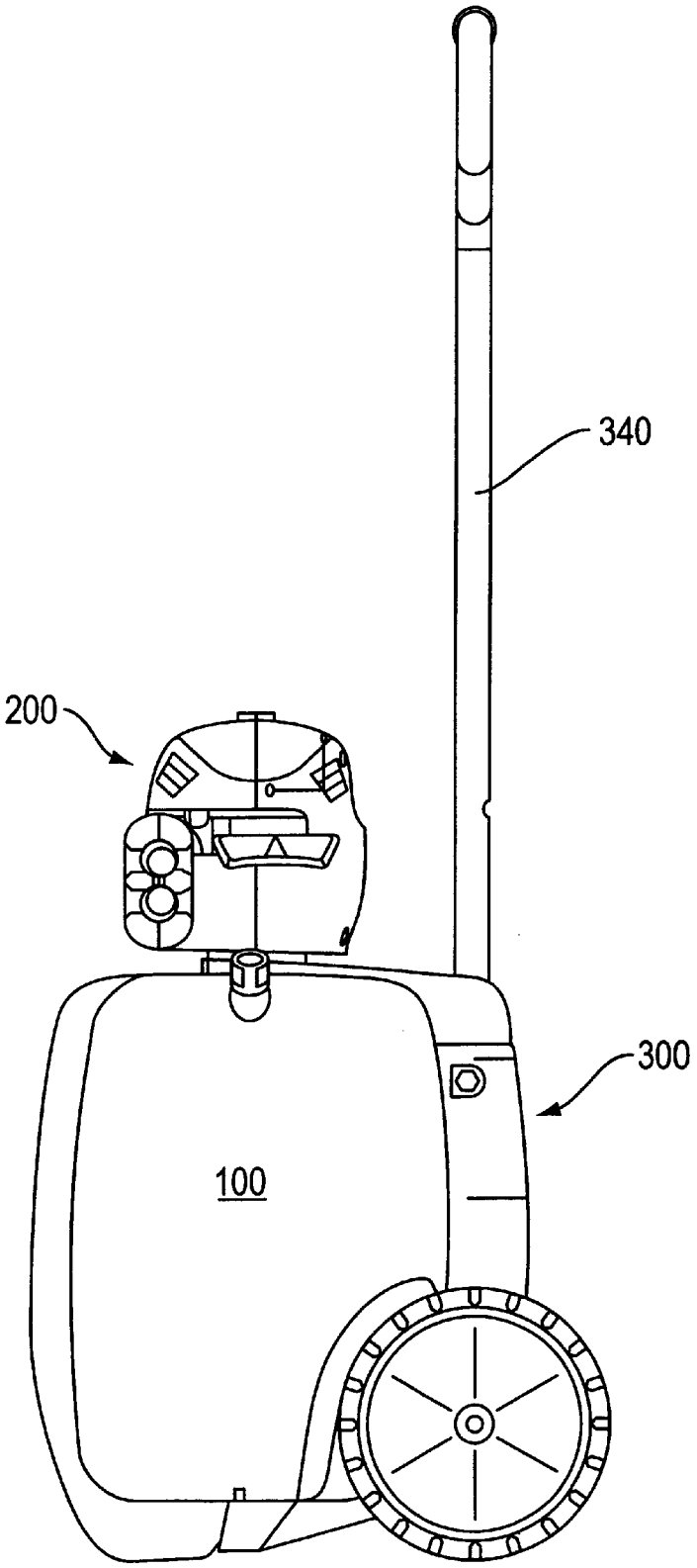
FIG. 4 is a right-side elevation view of the sprayer assembly.
Figure 5:
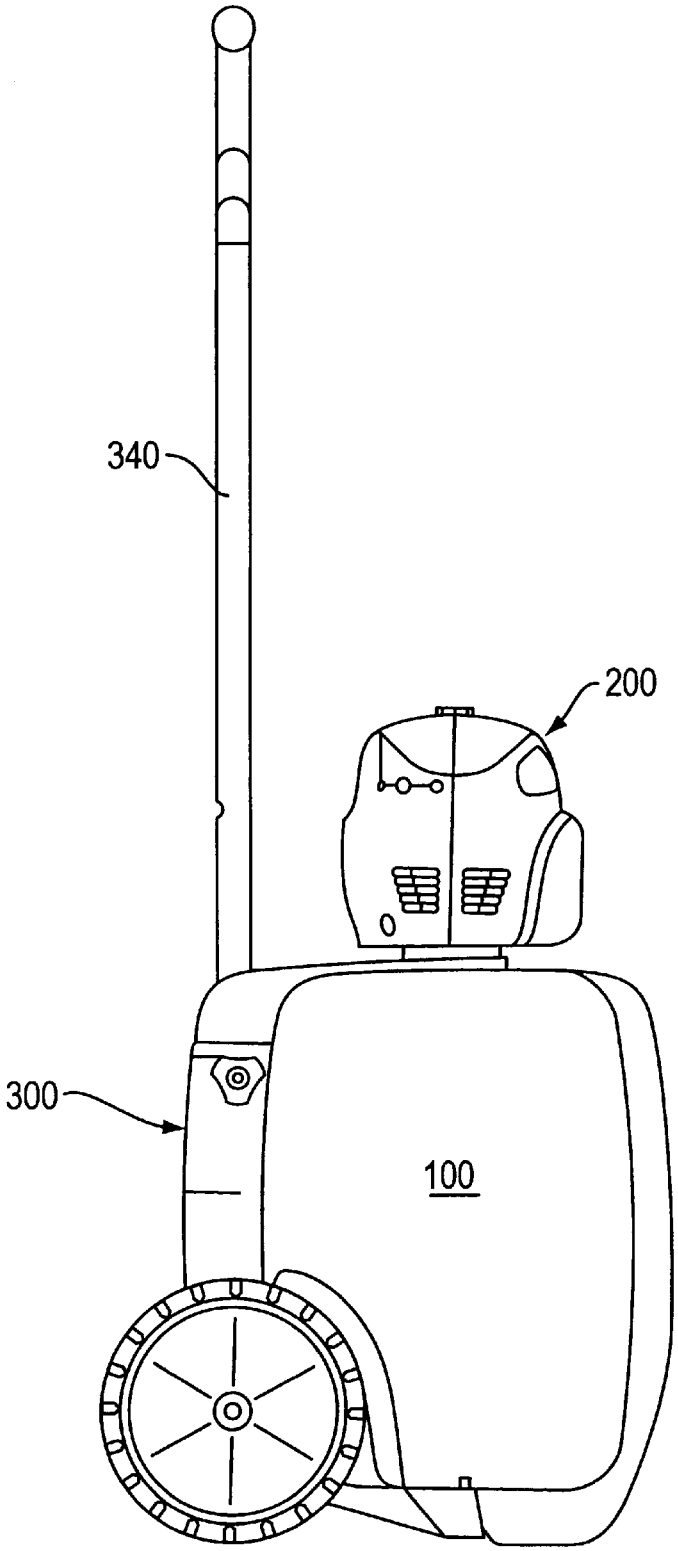
FIG. 5 is a left-side elevation view of the sprayer assembly
Figure 6:
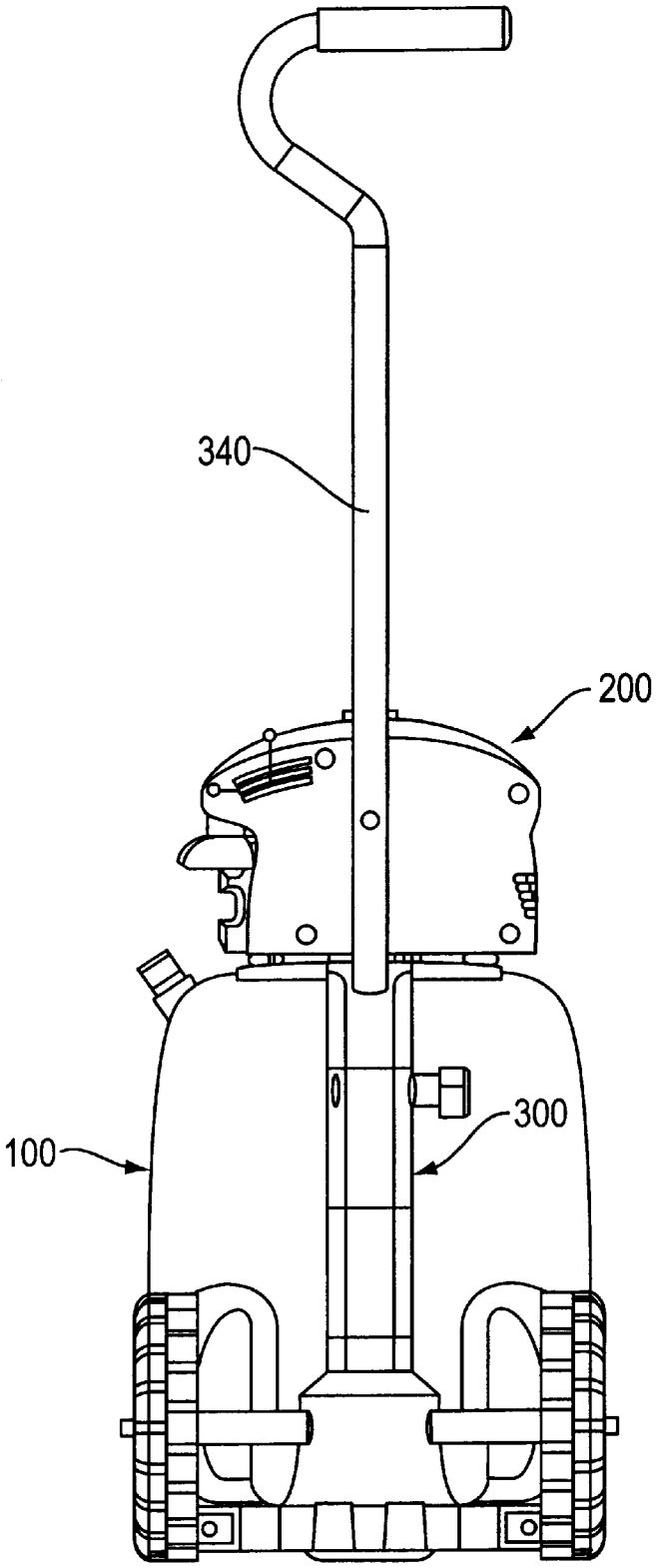
FIG. 6 is a rear elevation view of the sprayer assembly.
Figure 7:
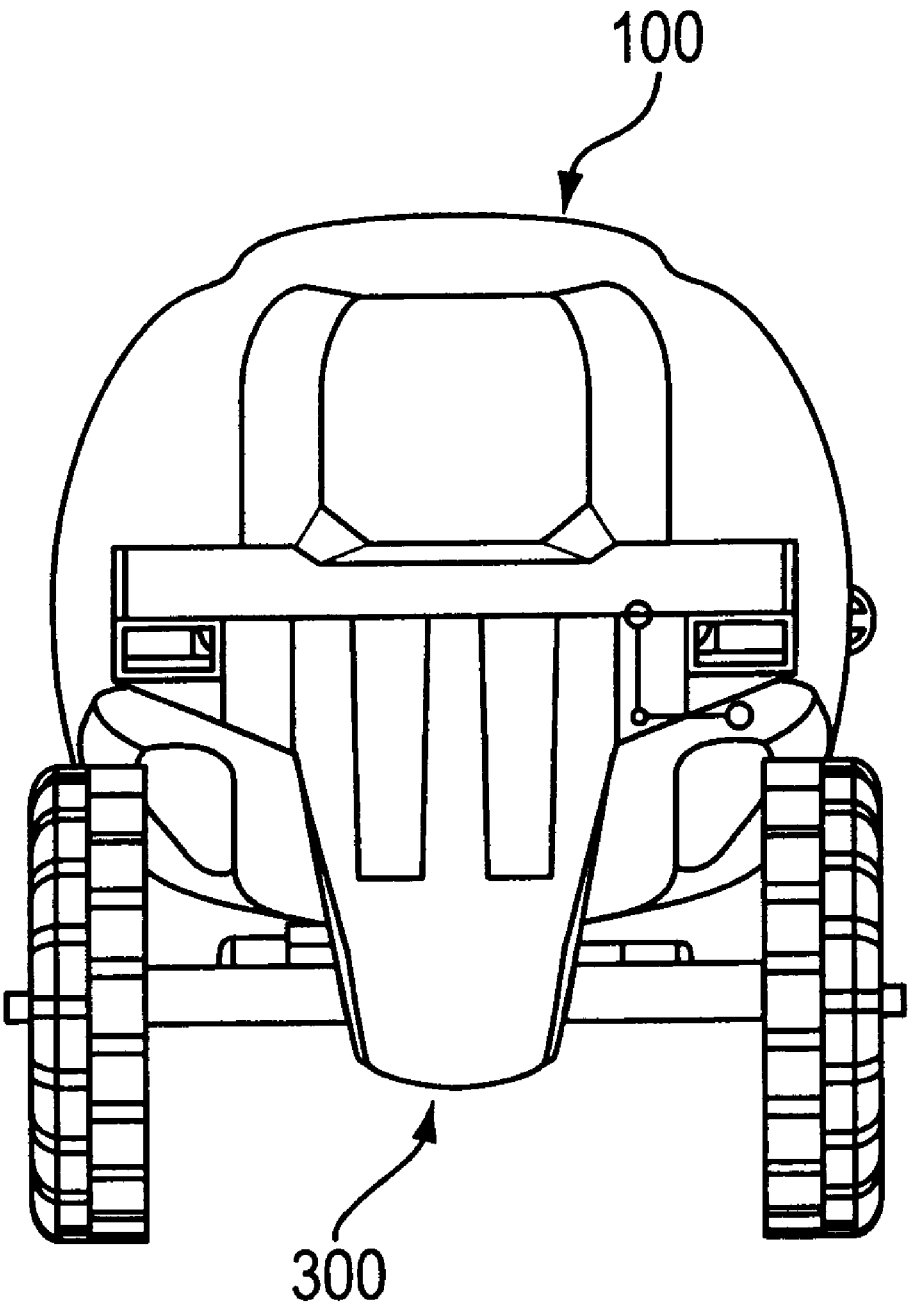
FIG. 7 is a bottom view of the sprayer assembly.

The connection between the lower portion of tank 100 and frame 300 is best understood referring to FIGS. 2, 10 and 12. The tank 100 is secured to the support portion 311 by pivot tabs 105*a* and 105*b* near the bottom of the tank 100. The pivot tabs 105*a* and 105*b* interlock within support arms 331 and 332 on the frame 300. Pivot tabs 105*a* and 105*b* project downwardly and each has a hole roughly in the center of the tab. Each support arm 331 and 332 of the frame 300 has a recessed section with a pin. Each recessed section engages with a respective tank pivot tab 105*a* and 105*b*, and the pins interlock with the holes in the tank pivot tabs 105*a* and 105*b*.

During assembly of the sprayer, tank 100 is engaged with frame 300 by tilting or pivoting the tank 100, engaging tank pivot tabs 105*a* and 105*b* with the support arm recess at a 45 degree angle from its normal assembled position, then tilting or pivoting the tank upright in the normal assembled position. Integral ribs on the frame 300 help guide the tank 100 into position during the assembly process.

Figure 14:
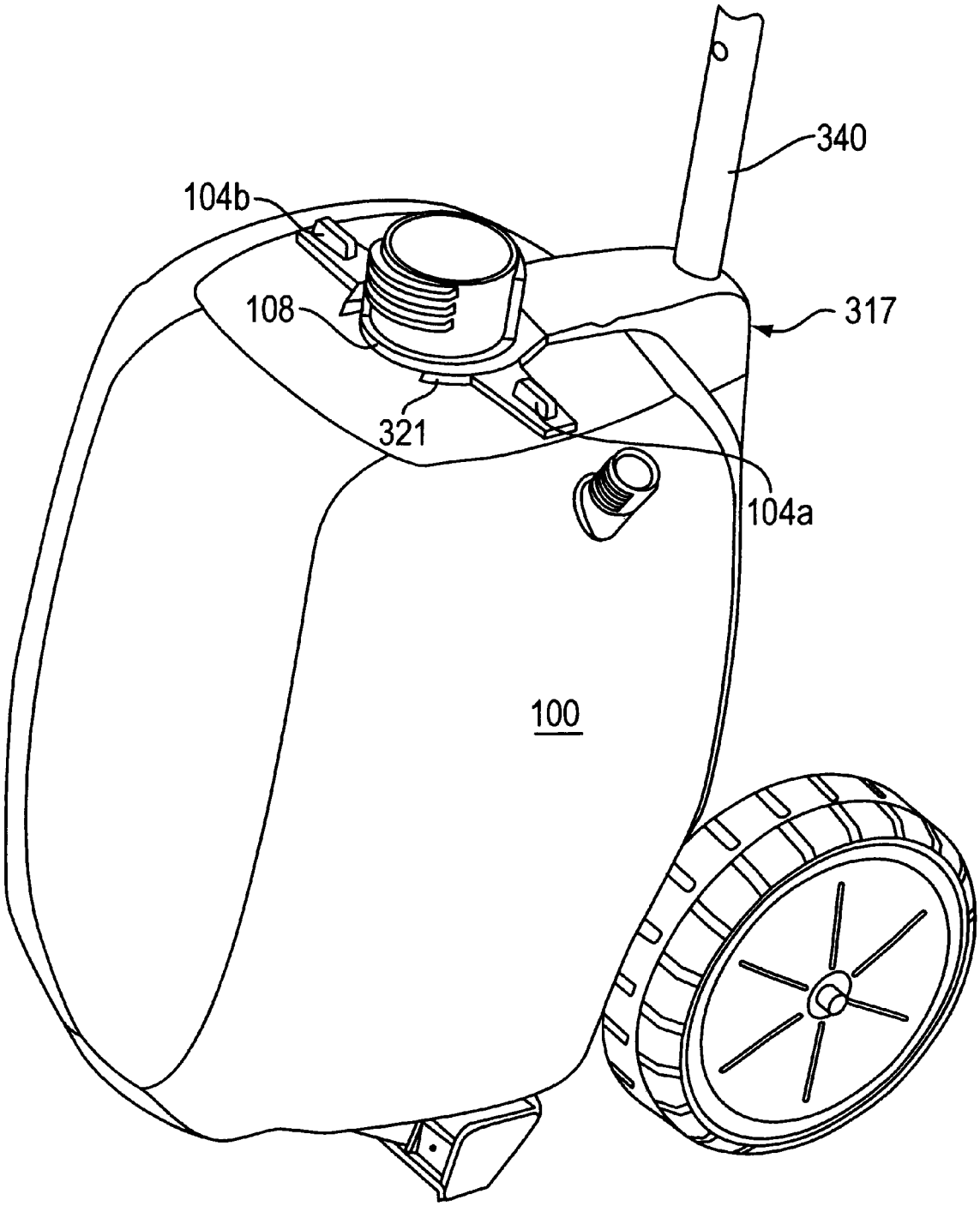
FIG. 14 is a perspective view showing the tank attached to the frame of the sprayer assembly.

As illustrated in FIG. 14, tank 100 is secured to upper arm 317 by key type openings 320*a* and 320*b* (see FIG. 12) on upper arm 317 that engage with projections 104*a* and 104*b* on tank 100. A collar 321 of upper arm 317 surrounds inlet 103 of tank 100 at inlet flange 108. Projections 104*a* and 104*b* are radially aligned on opposite sides of inlet flange collar 108, and each has a notch profile projecting through the key type openings 320*a* and 320*b* in the frame. The notches lock into the openings when the frame collar 321 is fully engaged with the corresponding inlet flange 108.

Referring to FIGS. 2, 8–11 and 23–24, power head 200 is mounted on top of tank 100. Opening 201 in power head 200 is secured onto inlet 103 of tank 100.

The power head 200 is designed such that disassembly from the tank 100 does not cause a sudden release of pressure from the tank 100. The head 200 is provided with a locking feature to ensure that once the sprayer is assembled and full pressure is attained, the head 200 must be deliberately unlocked prior to unscrewing and removing. As part of the unlocking action, there is a reduction in tank pressure prior to unscrewing. This reduction in tank pressure also reduces the effort required to unscrew the head 200.

Power head 200 is equipped with a release mechanism 210. Release mechanism 210 includes slide 212 that retractably projects outside head 200 for interlocking with locking projections 104*a* projecting upward from tank 100. Slide 212 travels vertically within guide 240 in the housing. Leading edge 213 of slide 212 is ramped so that when head 200 is rotated into a tightened position, slide 212 will lift up slightly until the head threads are fully engaged with tank 100. When head 200 is rotated to the point of the thread stop, a slot 214 in the lever section allows slide 212 to drop down on the locking projection 104*a* of tank 100. This locks the head 200 into position. The user must lift slide 212 by extended side projection 215 to disengage slide 212 from locking projection 104*a* and unscrew head 200 from tank 100.

Inside of head 200, release mechanism 210 comprises ribs 218 that support a pressure relief device 220. A main body of pressure relief device 220 is held on ribs 218, while a piston portion 221 of pressure relief device 220 is held in the housing by a groove 224 in piston 221 fitting into a slotted rib 242 in the housing. When slide 212 is lifted, the body of pressure relief device 220 moves with slide 212, while piston 221 is held down by housing rib 242, opening pressure relief device 220 and venting air pressure out through an integral tube 226 through the bottom of the housing.

Figure 20:
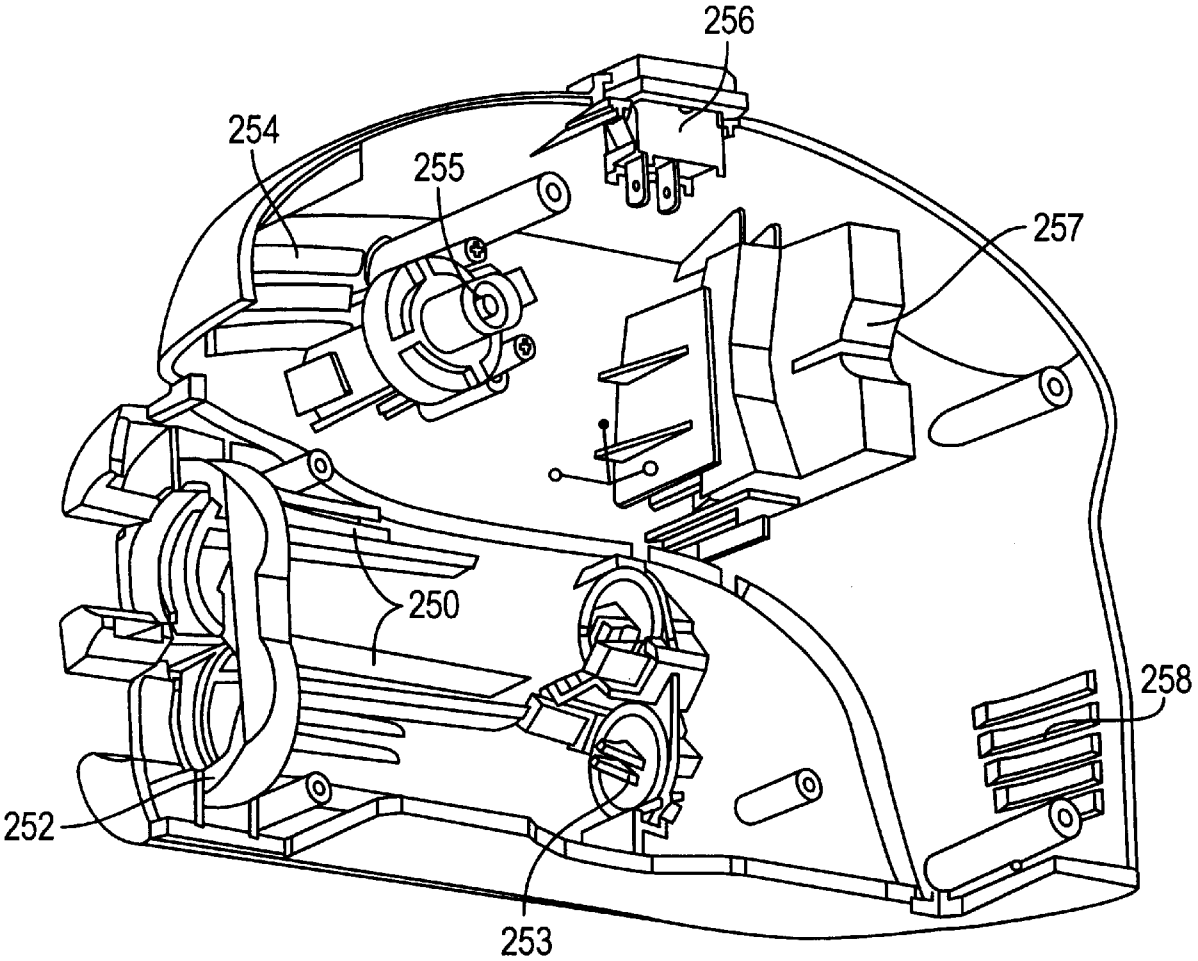
FIG. 20 is a perspective view of a partially assembled power head.

FIG. 20 illustrates the battery compartments including baffling ribs 250 and battery release 252. Terminal boards 253 are provided near the bottom of baffling ribs 250. Air vents 254 and 258 appear at various locations on the power head. A pressure controller 255 is associated with slide 212. A main switch 256 having a weather resistant cover is located on the top of power head 200. Front pump mount 257 is provided for mounting a pump that pressurizes tank 100.

Figure 21:
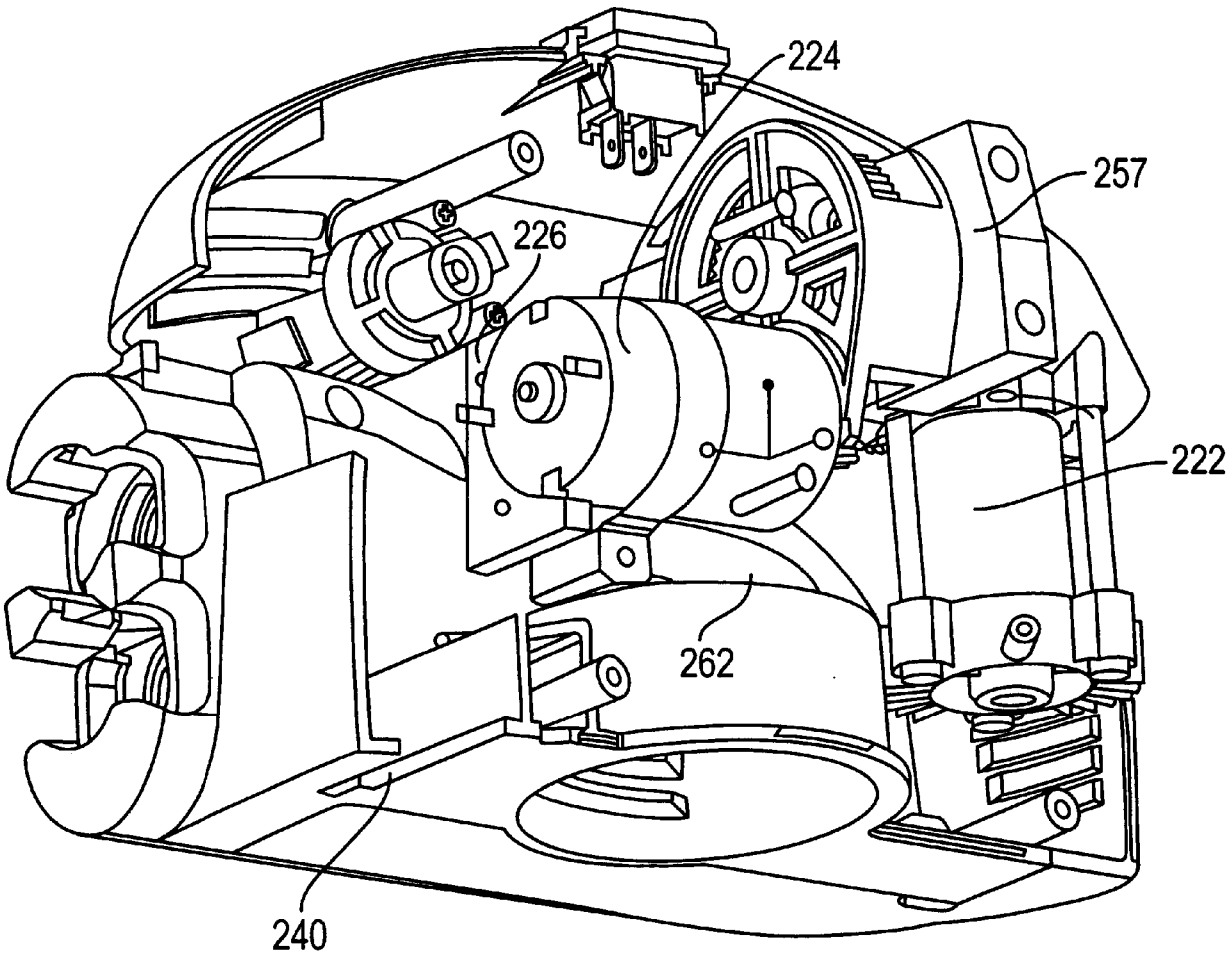
FIG. 21 is a perspective view of a further assembled power head.

As shown in FIG. 21, in its interior, power head 200 is equipped with a pump 222 powered by a motor 224. Pump 222 is mounted on pump mount 257, and when powered by motor 224, pressurizes the interior of tank 100. Main switch 256 is actuated when tank pressure gets below a given threshold in order to activate motor 224 and pump 222 to pressurize the interior of tank 100. Batteries are provided in the battery compartments for powering motor 224 and pump 222. Air vents 254 and 258 relieve pressure within power head 200.

Figure 15:
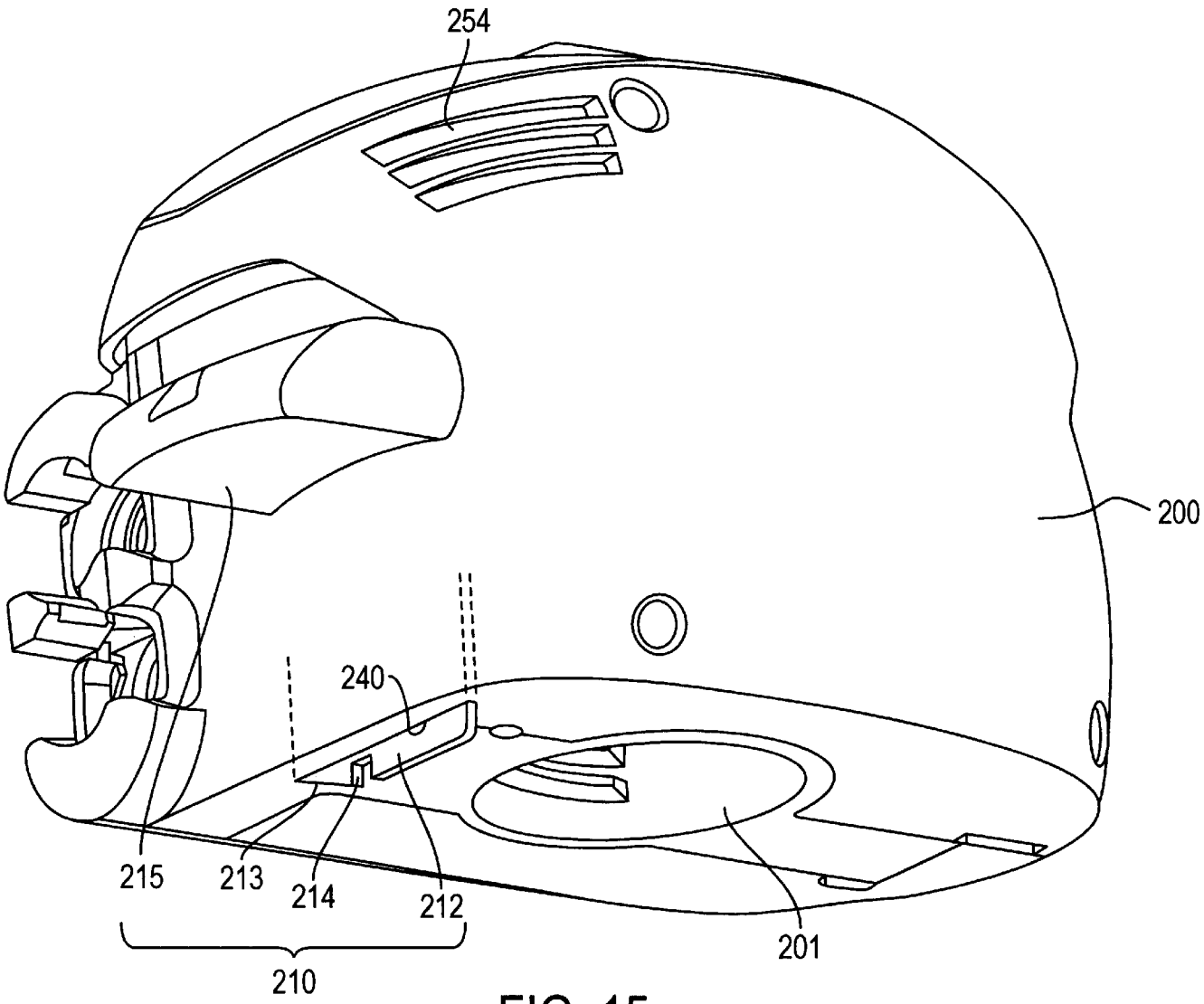
FIG. 15 is a perspective view of the power head of the sprayer assembly.
Figure 16:
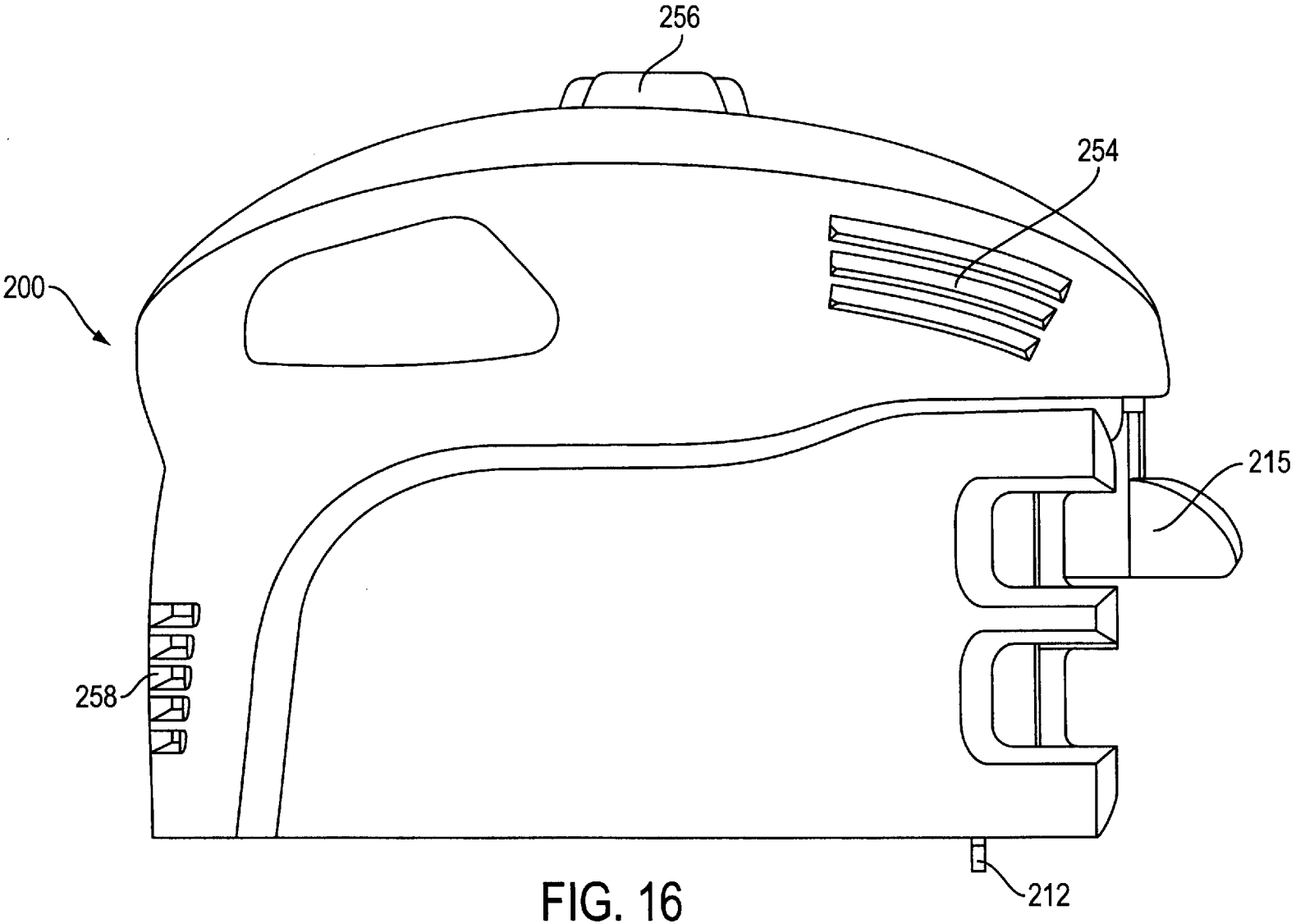
FIG. 16 is a front elevation view of the power head of the sprayer assembly.
Figure 17:
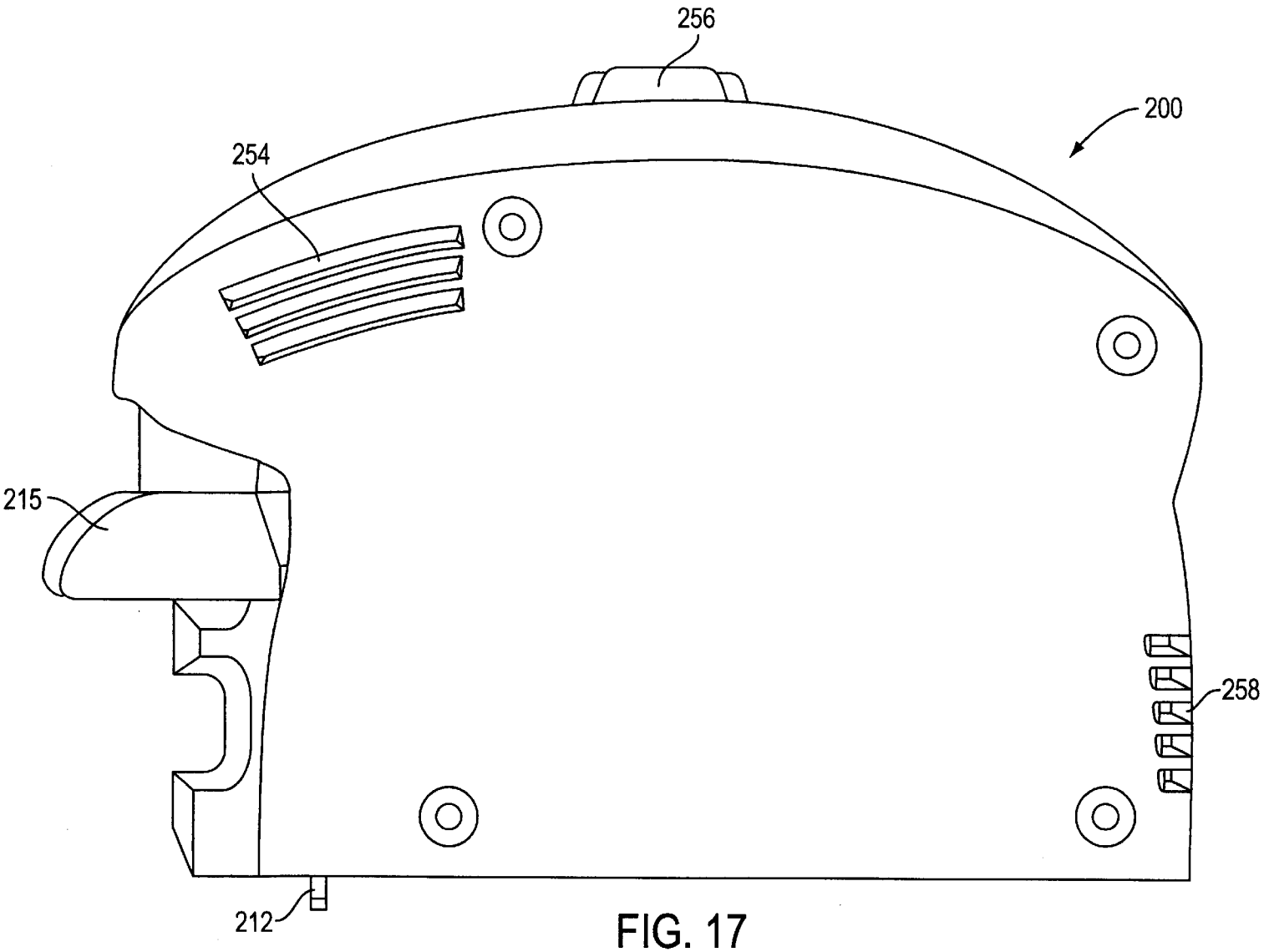
FIG. 17 is a rear elevation view of the power head of the sprayer assembly.
Figure 18:
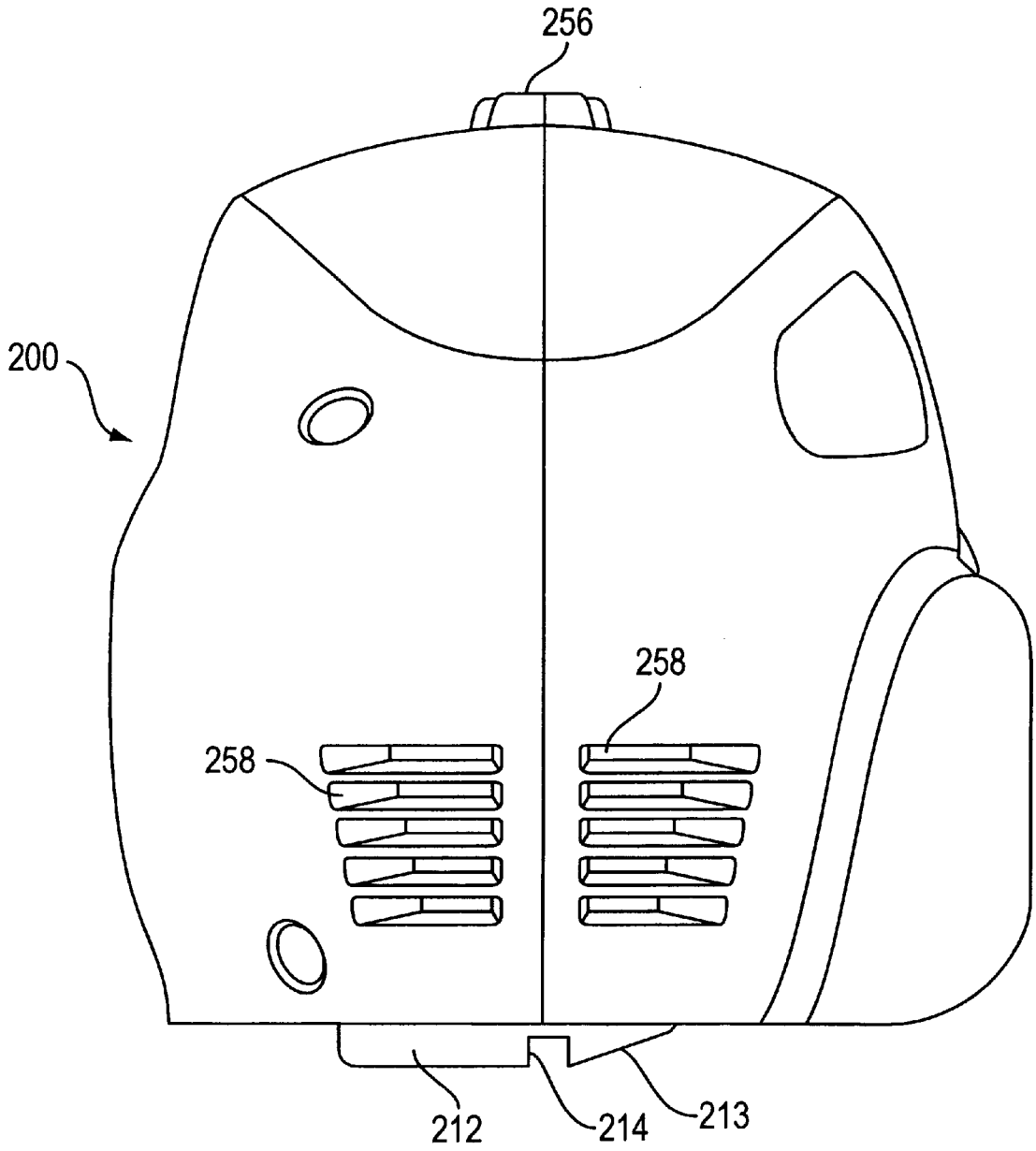
FIG. 18 is a left-side elevation of the power head of the sprayer assembly.
Figure 19:
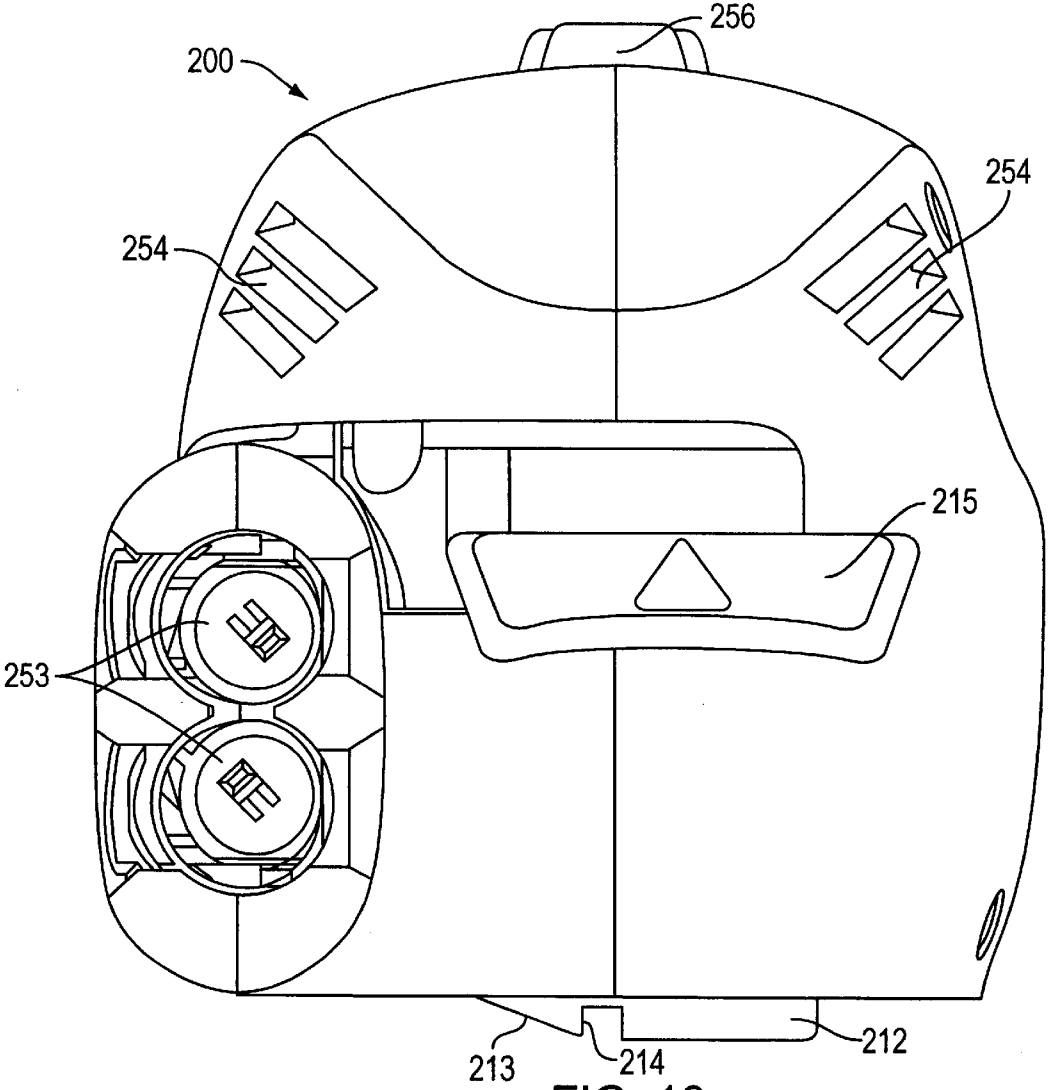
FIG. 19 is a right-side elevation of the power head of the sprayer assembly.
Figure 22:
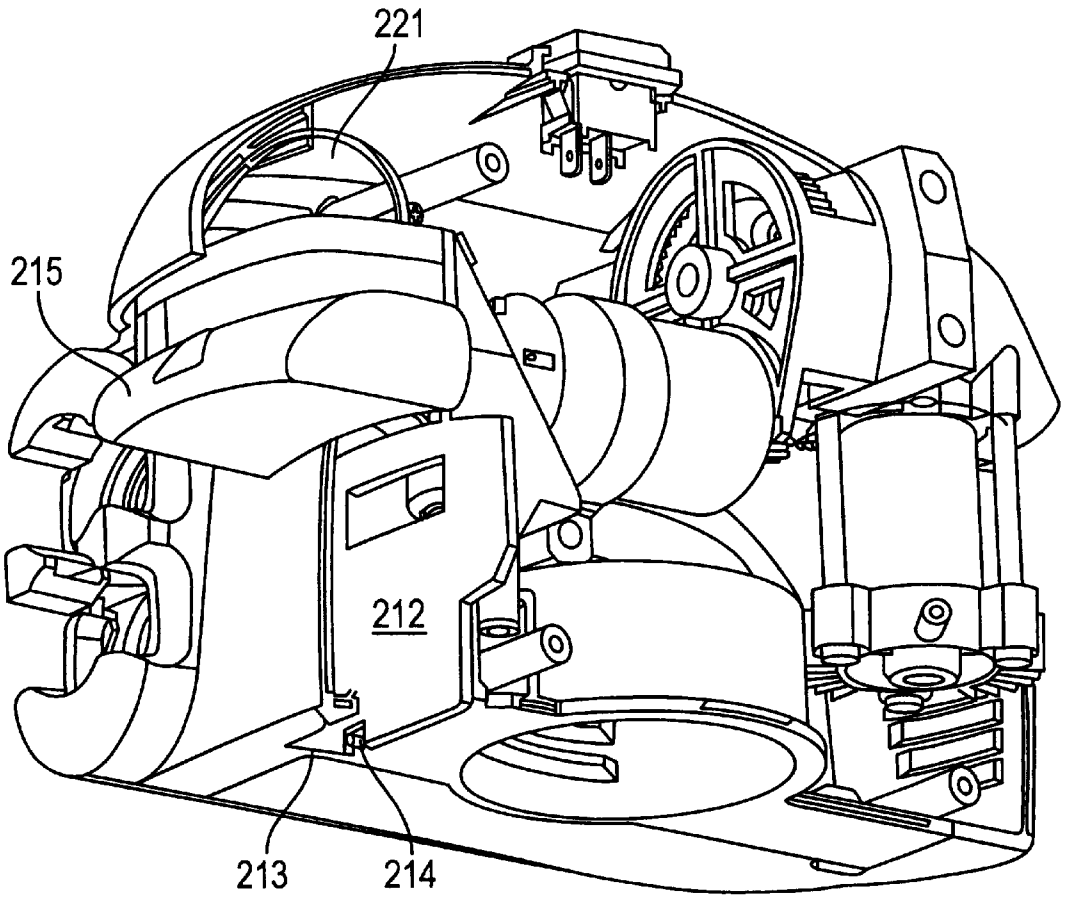
FIG. 22 is a perspective view of a further assembled power head.

As shown in FIG. 22, an integral molded spring 221 biases slide 212 toward tank 100. A ramp 213 is located at the base of slide 212 for abutting locking projections 104*a* on tank 100 as described in connection with FIG. 15. Notched portion 214 automatically locks onto locking projection 104*a* under the influence of spring 221.

Figure 23:
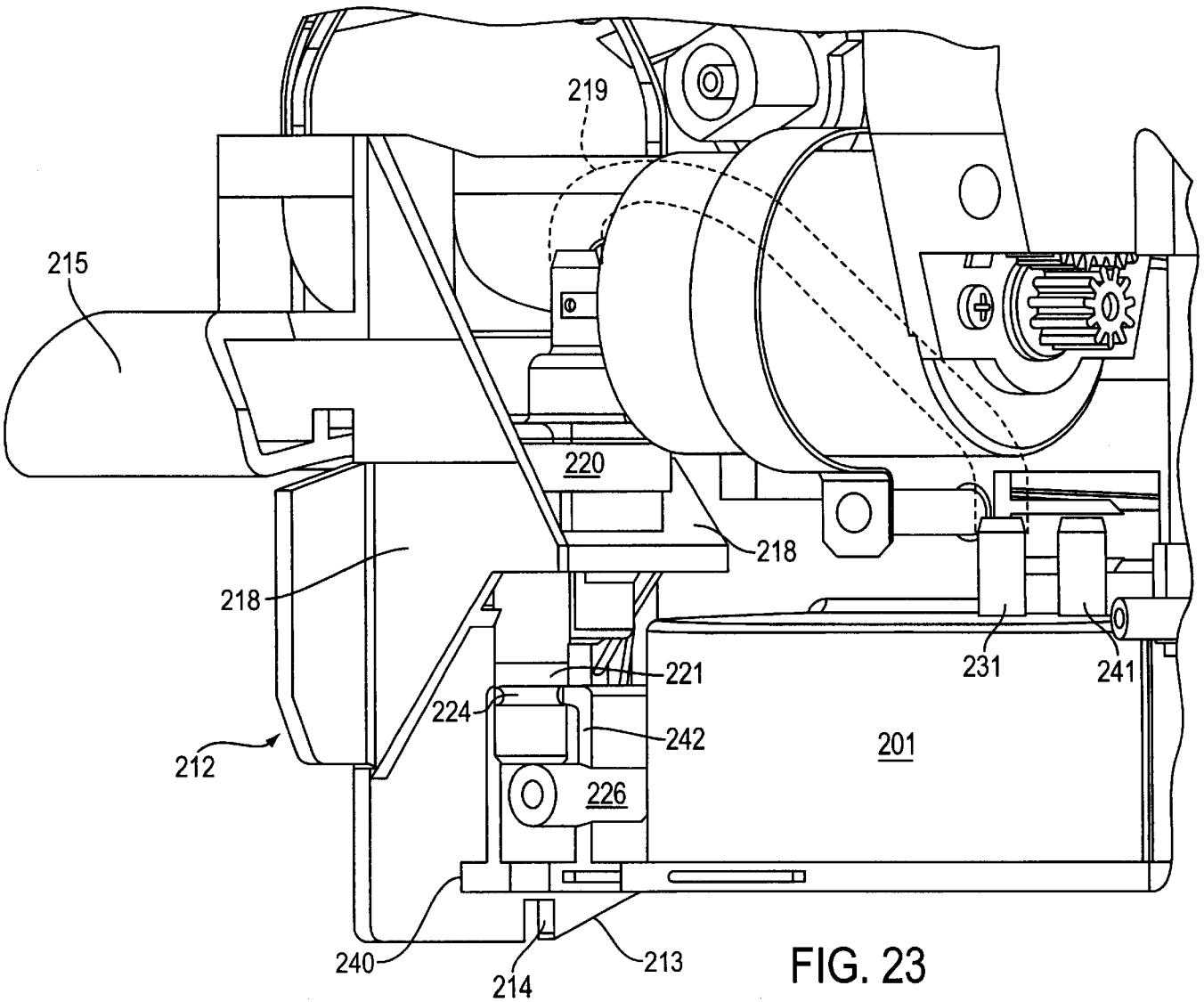
FIG. 23 is an additional perspective view showing the interior of the power head.

FIG. 23 shows further features of the power head including the guide 240 in the housing. A complimentary guide (not shown) exists on the opposite side of the slide 212. A hose 219 is provided for connecting opening 201 and pressure relief device 220. A pressure relief hole tube 226 is provided for venting upon actuation of slide 212. Spigot 231 allows for connecting pressure relief hose 219 within opening 201 of power head 200. Spigot 241 provides a connection for a hose (not shown) from pump 222.

Pump 222 is preferably a piston pump, but may be of any configuration capable of functioning within power head 200.

Figure 24:
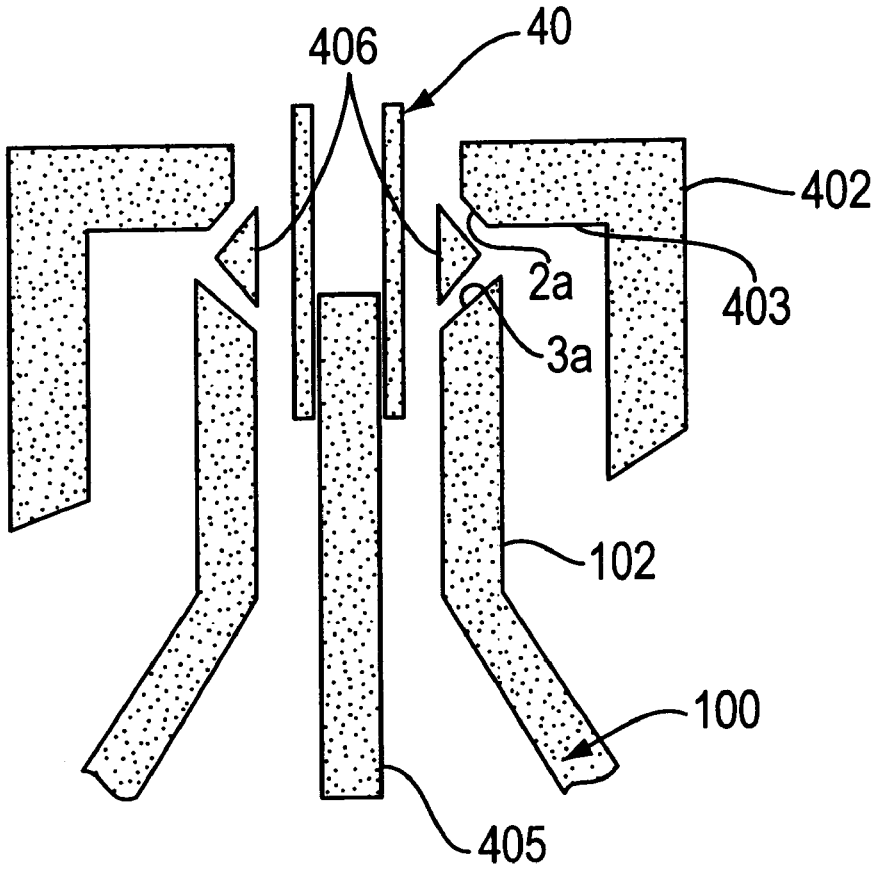
FIG. 24 is a schematic view of a hose to tank connection of the sprayer assembly.

As shown in FIG. 24, a simple and effective hose to tank connection is provided for transporting fluid between tank 100 and an outlet hose. The outlet hose to tank connection utilizes externally threaded outlet 102 of tank 100. A flexible hose 401 is connected through cap 402 to tank 100. Hose 401 extends around siphon tube 405. A gasket 406 is disposed adjacent the lip of threaded outlet 102, surface 403 of cap 402, and hose 401. Threaded outlet 102 of tank 100 and cap 402 exert a compressive force on gasket 406, thereby causing hose 401 to be flared out at its lower end and held open.

Figure 25:
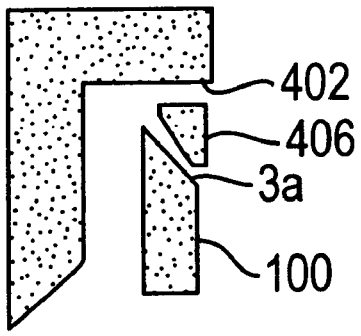
FIG. 25 is a partial schematic view of an alternative embodiment of the hose to tank connection.

FIG. 25 shows an alternative configuration for the shape of gasket 406 and cap 402.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A portable sprayer assembly comprising:

a tank for containing a fluid, the tank comprising a bottom, a top vertically spaced from the bottom, and side walls connecting the top and the bottom, the top having an inlet for introducing fluid into the tank;

a head portion removably mounted to the top of the tank, the head portion including a release mechanism that releasably locks the head portion to the top of the tank; and a pump unit for pressurizing the tank through the inlet, the pump being mounted inside the head portion, wherein the head portion, including the pump unit, is detachable together from the tank.

2. The portable sprayer of claim 1, wherein the pump is a piston pump.

3. The portable sprayer of claim 1, wherein the pump is powered by batteries.

4. The portable sprayer assembly of claim 1, wherein the head portion further includes a pressure relief mechanism that is operably connected to the release mechanism, wherein the pressure relief mechanism reduces pressure in the tank before the head portion is detached from the tank.

5. The portable sprayer assembly of claim 1, wherein the thickness of the top, bottom, and side walls vary so that the top wall is thinnest at the top.

6. The portable sprayer assembly of claim 1, wherein the top of the tank has outwardly extending locking projections that cooperate with the release mechanism.

7. The portable sprayer assembly of claim 6, wherein the release mechanism includes a retractable slide that engages one of the locking projections.

8. The portable sprayer assembly of claim 7; wherein the inlet is a threaded projection and the head portion has a complementary opening with a threading for receiving the threaded projection.

9. The portable sprayer assembly of claim 8, wherein the retractable slide has a slot, the retractable slide dropping down so that the slot engages the locking projection when the head portion is fully threaded to the threaded projection.

10. The portable sprayer assembly of claim 9, wherein the release mechanism further includes a side projection operably connected to the retractable slide for disengaging the retractable slide from the locking projection.

11. The portable sprayer assembly of claim 10, wherein the head portion further includes a pressure relief device for releasing pressure from the tank.

12. The portable sprayer assembly of claim 11, wherein the side projection is operably connected to the pressure relief device, which releases pressure in the tank when the retractable slide disengage the locking projection.

13. The portable sprayer assembly of claim 1, wherein the head portion further includes a pressure responsive switch that is actuated automatically when tank pressure drops below a given threshold level to activate the pump and pressurize the tank.

14. The portable sprayer assembly of claim 1, further including wheels for supporting the tank, and a handle operatively connected to the wheel and the tank to facilitate mobility of the tank.

15. The portable sprayer assembly of claim 1, wherein the head portion further includes one or more compartments for accommodating one or more batteries.

* * * * *